US005351882A

United States Patent [19]

Krautsack

[11] Patent Number: 5,351,882

[45] Date of Patent: Oct. 4, 1994

[54] FOLDABLE DISPLAY APPARATUS

[75] Inventor: Richard G. Krautsack, Arlington Heights, Ill.

[73] Assignee: Comark Merchandising, Inc., Elk Grove, Ill.

[21] Appl. No.: 903,898

[22] Filed: Jun. 25, 1992

[51] Int. Cl.[5] ..... B65D 5/02; B65D 5/52

[52] U.S. Cl. ..... 229/164; 206/44.12; 206/45.29; 248/174; 248/459

[58] Field of Search ..... 206/44.12, 425, 806, 206/45.29; 229/164; 211/73, 132, 133; 248/146, 150, 152, 174, 318, 470, 472, 489, 497, 459

[56] References Cited

U.S. PATENT DOCUMENTS

| | | | |
|---|---|---|---|
| 1,682,463 | 8/1928 | Anderson | 206/44.12 |
| 1,700,105 | 1/1929 | Ziemmerman | 248/459 |
| 1,901,351 | 3/1933 | Marx | 206/45.29 |
| 1,971,912 | 8/1934 | Horwath | 248/459 |
| 2,067,749 | 1/1937 | Zimmerman et al. | 206/44.12 |
| 2,153,460 | 4/1939 | Giles | 40/124.1 |
| 2,401,908 | 6/1946 | Calhoun et al. | 229/23 R |
| 2,765,906 | 10/1956 | Rossum | 206/44.12 |
| 2,803,076 | 8/1957 | Viglietta | 248/459 |
| 3,091,877 | 6/1963 | Luchsinger | 40/124.1 |
| 3,176,419 | 4/1965 | Stein | 40/125 |
| 3,219,181 | 11/1965 | Dahm | 206/45.29 |
| 3,225,474 | 12/1965 | Dusseau | 40/124.1 |
| 3,258,114 | 6/1966 | King | 206/44.12 |
| 3,481,061 | 12/1969 | Julin | 40/124.1 |
| 3,664,049 | 5/1972 | Smith | 40/124.1 |
| 3,775,884 | 12/1973 | Smith | 40/124.1 |
| 4,001,958 | 1/1977 | Fecko | 248/459 |
| 4,016,977 | 4/1977 | Krautsack | 206/526 |
| 4,235,032 | 11/1980 | Robinson | 40/539 |
| 4,718,545 | 1/1988 | Chrzanowski et al. | 206/45.29 |
| 4,763,427 | 8/1988 | Schrager | 40/124.1 |
| 4,839,977 | 6/1989 | Krautsack | 40/658 |

FOREIGN PATENT DOCUMENTS

| | | | |
|---|---|---|---|
| 274036 | 5/1930 | Italy | 248/174 |

*Primary Examiner*—Gary E. Elkins
*Attorney, Agent, or Firm*—Fitch, Even, Tabin & Flannery

[57] ABSTRACT

A display apparatus can be hung from a shelf edge or wall or mounted free-standing in a generally erect position from a counter-top surface. The display apparatus is formed from an integral paperboard blank and is folded to form a four-sided closed tube which can be compressed into a flat package for shipment. An easel support is provided at the rear wall of the display apparatus and includes two flaps which are slung away from the rear wall so as to interlock with one another.

4 Claims, 2 Drawing Sheets

FOLDABLE DISPLAY APPARATUS

BACKGROUND OF THE INVENTION

1. Field of the Invention

The present invention pertains to foldable display devices which are shipped flat, and are quickly and easily erected, and in particular to such devices having either a free-standing receptacle or show card.

2. Description of the Related Art

Consumer merchandise is sometimes displayed or stored in a case having a counter-top, or in a relatively short shelf unit having a top surface which may be used as a counter-top, or in a taller shelf unit having space reserved at eye level for display and promotional material. In the past, merchandisers have offered show cards of the self-standing type which are relatively small in size so as to be used on a counter-top or eye level display shelf area. U.S. Pat. No. 2,153,460 describes a show card formed of paper stock which is cut and folded by the show card manufacturer so as to require a minimum of skill and time to erect the show card. Frequently, manufacturers of merchandise produce and offer display devices for use by store personnel to enhance the display of the merchandise, to provide consumer information or to attract the consumer's attention to a particular display area. Store personnel who are offered a wide variety of display devices from time to time may not be familiar with the construction of a particular display device and may encounter difficulty in its use.

Accordingly, an effort has been made by display manufacturers to provide a display device which can be quickly and easily erected. Instructions for erecting the device can be printed on or otherwise secured directly to the display device to assist store personnel. Alternatively, the display device can be erected with elastic bias members, such as rubber bands, so as to automatically "pop" into position, providing a self-erecting display. U.S. Pat. No. 2,153,460 provides a display device of this type in which an elastic band is arranged to automatically expand folded portions of a show card. The show card has an upstanding wall surface maintained in an erect position by a locking flap located behind the wall. A slot formed in a strut at the rear of the card provides an edge engageable in a recess of the locking flap to maintain the strut in a position for erect configuration of the display device. The strut and locking flap are formed from card material which is cut and folded into the desired position.

U.S. Pat. No. 3,091,877—Luchsinger also discloses a self-erecting display device. The display device is formed as a greeting card having a flat package configuration when folded. When the card is opened, an elastic band causes panels of the greeting card to expand or "pop out" in a selected sequence when the card is opened. The greeting card is formed from a single sheet of flexible material such as cardboard, paper or plastic. Panels of the card are folded along hinge lines, and an elastic band is stretched between selected panels so as to provide a self-opening force when the greeting card is opened.

U.S. Pat. No. 3,225,474—Dusseau provides a card adapted to be placed in an upright position when the flat package device is unfolded. The card has a pop-up action provided by the force of an elastic band which pops up one portion of the card when the device is unfolded.

The need has arisen for a flat package display device having a receptacle and supporting means so as to hold the receptacle in a free-standing upright position.

SUMMARY OF THE INVENTION

It is an object according to the present invention to provide a display article such as a free-standing receptacle or show card maintained in an upstanding position.

Another object according to the present invention is to provide a display article of the above-described type which is quickly and easily erected from a flat package.

A further object according to the present invention is to provide a display article of the above-described type having a locking easel arrangement at the rear of the article as to hold the article at an angle inclined from the vertical.

These and other objects according to the present invention which will become apparent from studying the appended description and drawings, are provided in a display apparatus formed from a one-piece blank, comprising:

an upright receptacle portion having a central axis offset from a vertical direction, including a bottom wall and sidewall means extending from the bottom wall and having front and rear walls extending at non-perpendicular angles to the bottom wall; and an upright support means for supporting the receptacle portion, extending from the rear wall and having a bottom edge coplanar aligned with at least a portion of the bottom wall.

DETAILED DESCRIPTION OF THE PREFERRED EMBODIMENT

Figure 1:
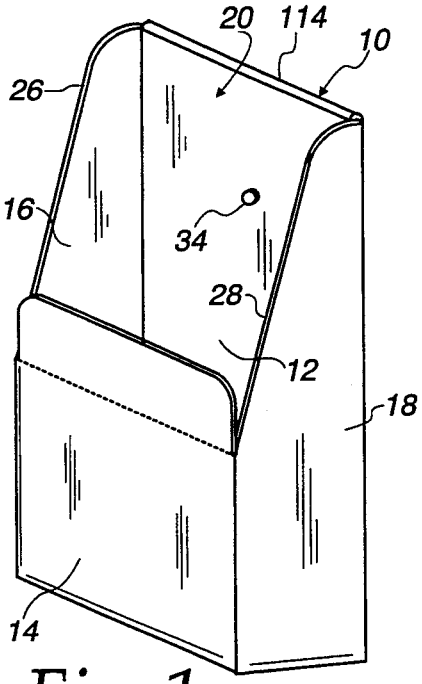
FIG. 1 is a perspective view of display apparatus according to principles of the present invention.
Figure 8:
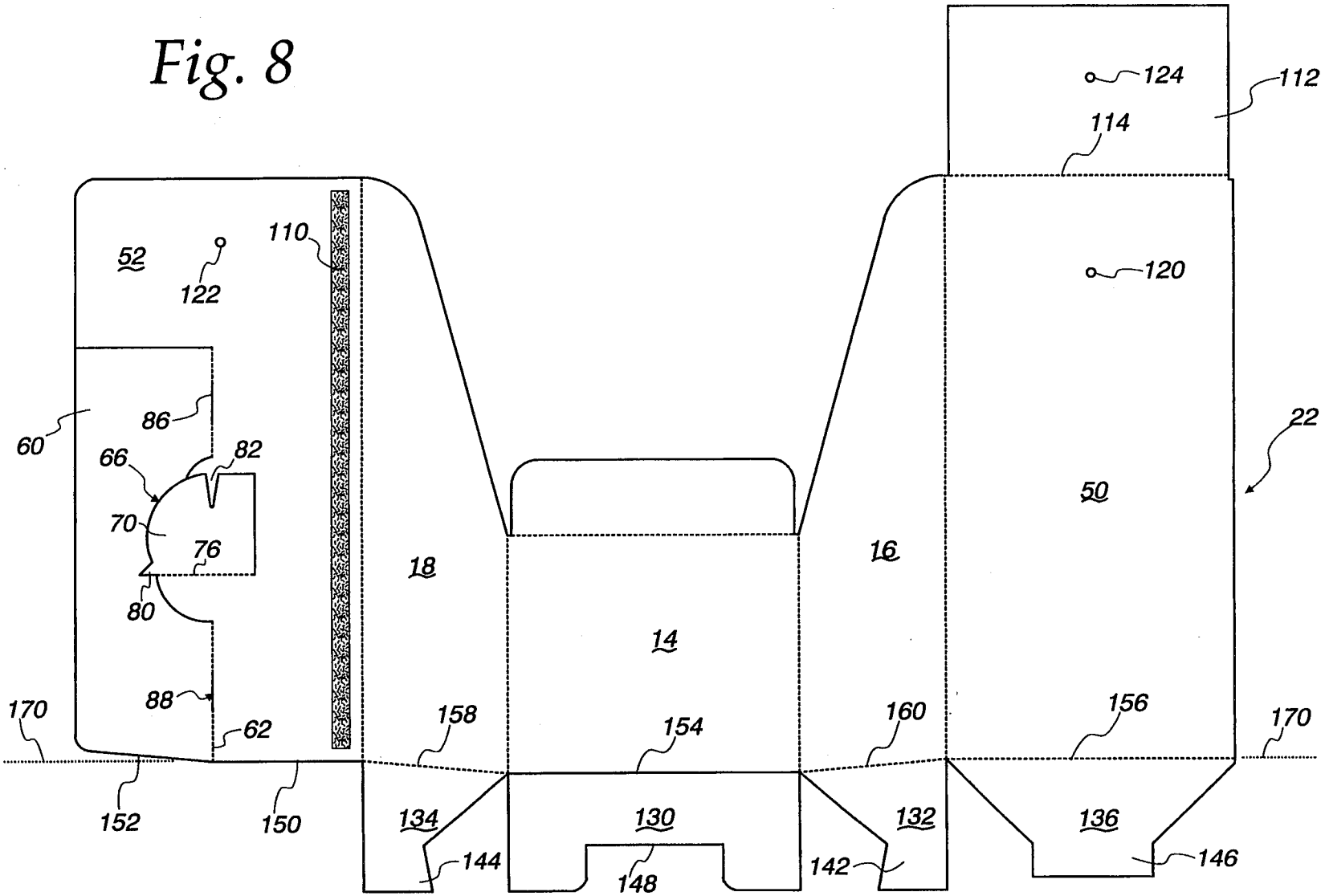
FIG. 8 is a top plan view of a blank from which the apparatus is constructed.

FIG. 1 shows display apparatus generally indicated at 10, fully assembled, and in an erect position. Apparatus 10 includes a display member in the form of a receptacle portion 12 formed by a front wall 14, sidewalls 16, 18 and a rear wall 20. The display member could optionally comprise a generally planar show card or other display not necessarily comprising a receptacle. A bottom wall or floor 19 (see FIG. 2) encloses the bottom end of the receptacle. The bottom flaps fold and interlock to form the bottom wall of the receptacle as can be seen in FIG. 8, which shows a blank 22 from which the carton apparatus is formed. The present invention also contemplates free-standing articles of other types, such as a show card in which the front wall 14 and sidewalls 16, 18 are omitted.

Figure 2:
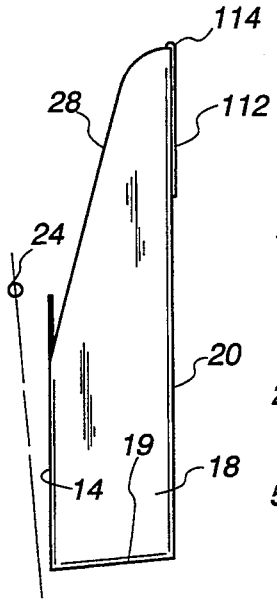
FIG. 2 is a side elevational view thereof.
Figure 4:
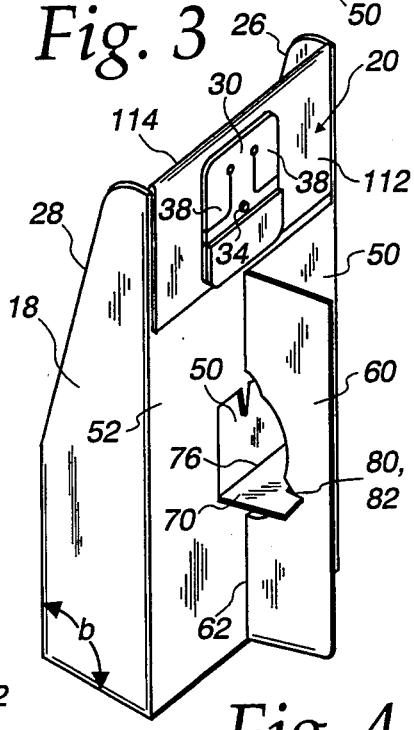
FIG. 4 is a perspective view thereof showing a rear corner of the apparatus.

As can be seen in FIG. 2, the front and rear walls 14, 20 are generally parallel to one another and inclined from a reference vertical line 24 so as to form an acute angle therewith. The bottom wall 19, however, is generally perpendicular to the vertical line 24, and thus is non-perpendicular to front and rear walls 14, 20. The front wall 14 is considerably shorter than the back wall, and the sidewalls 18 have angled edges 26, 28. FIGS. 1 and 2 show the display apparatus in a partially assembled condition, the receptacle portion 12 thereof being fully expanded with folding and interlocking of the bottom flaps. FIGS. 1 and 2 show the display apparatus prior to erection of the easel support (as seen in FIG. 4) or alternatively, mounting of the apparatus by hanging (see FIGS. 5–7).

Figure 5:
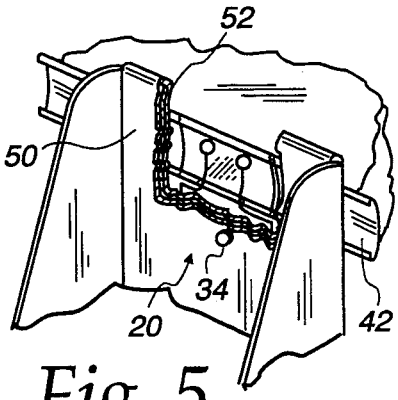
FIG. 5 is a fragmentary perspective view, shown partly cut away, of the apparatus attached to a shelf edge.

Referring now to FIGS. 3–7, a mounting clip preferably made of plastic material is indicated at 30. Clip 30 provides multiple modes of mounting for the display apparatus, and includes an adhesive strip 32 at its lower end. The clip is secured to back wall 20 by a rivet fastener 34. Ears 38 may be deflected out of the plane of the clip, and inserted in a C-shaped channel at a shelf edge 42, as illustrated in FIG. 5.

Figure 3:
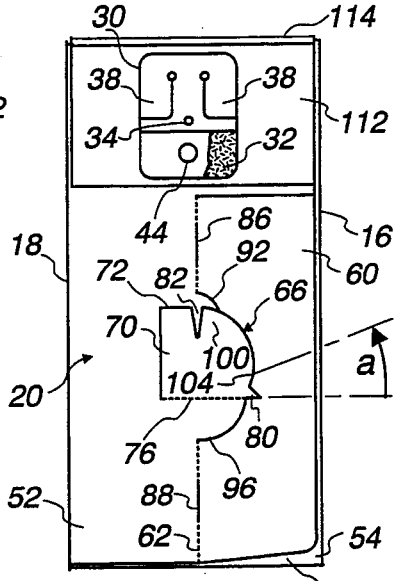
FIG. 3 is a rear elevational view thereof.
Figure 6:
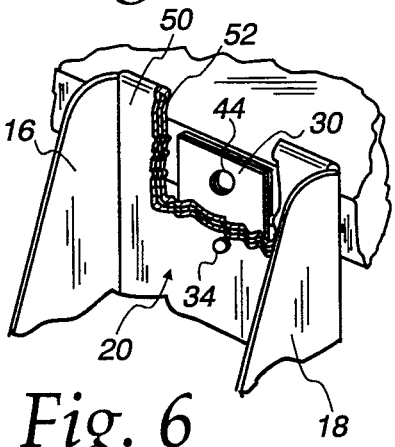
FIGS. 6 and 7 are fragmentary perspective views similar to FIG. 5, but showing alternative mounting arrangements for the apparatus.

Alternatively, the tab 30 illustrated in FIG. 3 may be rotated about rivet fastener 34 to bring aperture 44 toward the upper free edge of the display apparatus, so as to receive a nail fastener or the like, as illustrated in FIG. 6. The self-adhesive strip 32 may also be applied directly to a shelf edge or vertical mounting surface in the manner illustrated in FIG. 7. Further details concerning clip 30 may be found in commonly assigned U.S. Pat. No. 4,016,977, the disclosure of which is incorporated by reference as if fully set forth herein.

Figure 7:
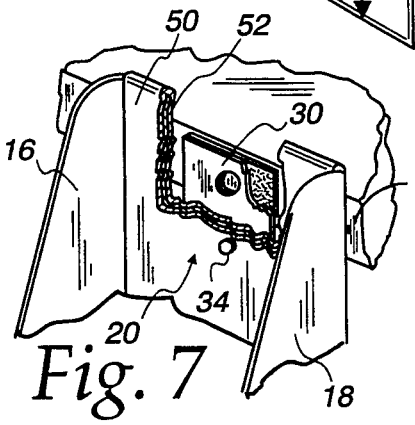

As shown in the cutaway portions of FIGS. 5–7, rear wall 20 is comprised of two, almost completely overlying plies or layers 50, 52. When the mounting clip 30 is employed, both layers 50, 52 function as the rear wall, and hence may be referred to as rear wall layers. However, a support may be formed from at least one of the layers if the mounting clip is not desired. Referring to FIG. 3, the rear layer 52 almost completely overlies the forward layer 50, except for a relatively small triangular exposed portion 54 shown at the bottom right corner of FIG. 3. This bevelled-wall construction allows the easel-like support means illustrated in FIG. 4 to be struck out of the rear wall 20 without interrupting the continuous forward surface of the wall (i.e., the surface of layer 50) bounding the interior of receptacle 12.

Referring again to FIGS. 3 and 4, the support means for the display apparatus includes a vertical flap or support wall 60 struck from the rear wall layer 52, so as to be foldable along a hinge line 62 preferably located along a centerline of the rear wall 20. According to one aspect of the present invention, the hinge line 62 is interrupted by a cut line generally indicated at 66. The cut line 66 forms part of a flap or locking tab 70 by providing a curved internal edge in wall 60 to accommodate swinging of tab 70. The same cut line 66 forms a convex peripheral edge of a locking tab 70. A cut line 72 intersects with the aforementioned cut line 66 so as to complete formation of locking tab 70, with the locking tab being hingedly connected to the rear layer 52 of rear wall 20 by a hinge line 76.

Referring again to FIG. 3, the cut lines 66, 72 each include V-shaped notch portions 80, 82 which interlock with one another in the manner indicated in FIG. 4 to hold the rear support 60 outwardly away from rear wall 20, preferably at a generally right angle thereto. According to one aspect of the present invention, the V-shaped notch 80 formed in the support 60 extends along the fold line 76 for mounting the locking tab, and the V-shaped notch 82 formed in the locking tab is aligned with the fold line 62. In the preferred embodiment, the fold line 62 is preferably formed by scoring, except for full-cut portions 86, 88.

Referring again to FIG. 3, the cut line 66 is preferably formed from a series of three curved, preferably arcuate line portions 92, 94 and 96. The major, central cut portion 94 preferably is part circular, but may have other rounded configurations. The cut portion 94 extends between notches 80, 82. Curved cut line portions 92, 96 are located on either side of the central cut portion 94 and extend to the common hinge line 62. The cut line portion 92 could be omitted if desired, with the upper end of cut portion 94 extending to the fold line 62. However, the addition of cut portion 92 has been found advantageous in strengthening portion 100 of locking tab 70, located adjacent V-notch 82 (see FIG. 3). The bottom cut portion 96 could also be omitted, but is preferred so as to allow an extension of fold line 76 to that vertical half-portion of rear wall 20 adjacent sidewall 16. The cut line 66 forms an internal recess edge in flap 60 and part of the peripheral edge of flap 70.

As can be seen in FIG. 3, the V-shaped notch 82 formed in locking tab 70 extends to a considerable depth. With rear support 60 folded at a generally right angle to the rear wall 20, the V-shaped notch 82 guides the opening of locking tab 70 away from rear wall 20 to the fully locked position illustrated in FIG. 4, with the sides of the V-shaped notch sliding along support wall 60. Owing to the V-shaped configuration of the notch 82, the locking tab is guided into the locked position of FIG. 4, and aids in aligning the support wall 60 to its desired position if the support wall is not aligned exactly at 90° to the rear wall 20.

Referring again to FIG. 3, the depth of notch 82 is dimensioned such that the base of the notch engages the cut edge 94 of support wall 60 at an angle a from its locked position (i.e., measured with respect to the direction of fold line 76). This point of intersection with cut line 94 is located below a vertical tangent point on curve line 94, at a point where the curved line is extending toward fold line 62. As the base of notch 82 contacts the point 104 along curve line 94, and is moved toward notch 80, bias forces are stored in locking tab 70 owing to the resilience of the sheet material from which the display apparatus is formed. These stored forces are released as the base of notch 82 enters notch 80. As a result, the locking tab 70 snaps into engagement with support wall 60, locking the support wall and tab 70 in the position illustrated in FIG. 4.

Turning now to FIG. 8, the carton blank 22 is shown with the internal surface exposed. For example, the front wall 14 visible in FIG. 8 faces the interior of the receptacle, being hidden from view in FIG. 1. The blank 22 is folded about the vertical fold lines shown in FIG. 8 to form a closed tube, and a strip of adhesive coating 110 applied to the inside surface of layer 52 is pressed against the outside surface of rear wall layer 50 to join the tube in a closed position.

An optional flap 112 is hingedly connected to rear wall layer 50 by a fold line 114, and is folded back against the external surface of rear wall layer 52, with the fold line 114 presenting a finished edge at the upper end of the display apparatus, as can be seen in FIG. 1.

Apertures 120–124 are formed in rear wall layers 50, 52 and flap 112, respectively, and are brought into registry with one another when the blank is assembled in a tubular form. The rivet fastener 34 is inserted through these aligned apertures 120–124, to flap 112. The tube is then flattened for shipment to an end user.

Upon receipt of the folded display apparatus, the user opens the collapsed tube, bringing the sidewalls 16, 18 into right-angle orientation with front and rear walls 14, 20 to form a tube of generally rectangular cross-section. Referring to FIG. 8, bottom flaps 130, 136 extend from front wall 14, sidewalls 16, 18 and forward layer 50, respectively. The bottom flap 130 is folded at a generally right angle to the front wall 14 and the bottom flaps 132, 134 are then folded at generally right angles to the walls from which they extend, so as to bring the pointed comers 142, 144 against bottom flap 130. Thereafter, the bottom flap 136 is folded against the remaining bottom flaps, and the generally rectangular extension part 146 is pressed against bottom flap 130, pushing the flap 130 within the closed tube.

With continued pushing, the extension part 146 of bottom flap 136 passes edge 148 and the bottom flaps are allowed to relax, thus sandwiching the extension part 146 between the corners 142, 144 and the inner surface of bottom flap 130. The bottom wall is thereby completely formed. At this point, the display apparatus can be hung in the manner illustrated in FIGS. 5–7, for example, or the display apparatus can be configured for free standing support as illustrated in FIG. 4. If free standing support is desired, the support flap 60, which is struck out from the carton blank, is swung away from rear wall layer 50 to a generally right angle and the locking tab 70 partially struck out from flap 60, is then swung away from the rear wall layer 50 for locking engagement as illustrated in FIG. 4, and as described above. The cut portion 94 described above forms a recess in support flap 60 with a concave recess edge (as viewed from the locking flap).

The bottom wall of the display apparatus and the bottom edge of support wall 60 extend at an angle b to the front wall 14 which is somewhat less than 90° (see FIG. 4). The angular offset referred to here is that also illustrated in FIG. 2. This desired orientation is economically provided by the arrangement of fold lines joining bottom flaps 130, 136 to the walls of the display apparatus. Referring again to FIG. 8, the rear wall layer 52 has a bottom edge portion 150 which extends in a generally horizontal direction, generally perpendicular to the fold lines between the walls 14–18, 50 and 52 which preferably are arranged parallel to one another.

Rear wall layer 52 further includes a bottom edge portion 152 inclined at an acute angle to edge 150 so to form the triangular portion 54 illustrated in FIG. 3. This acute angle offset is generally equal to the difference between the angle b of FIG. 4 and the vertical. The bottom edge 150 is generally parallel to the fold lines 154, 156 joining bottom flaps 130 and 136, respectively, but preferably is not colinear therewith. Rather, there is a small lateral offset between edge 150 and fold line 136 and a larger offset between edge 150 and fold line 154. The fold lines 158, 160 arranged on either side of fold line 154 are angularly offset with respect to the fold line 154, in a direction so as to converge toward the fold line 154. The edge 150 of rear wall layer 52 is located generally at the bottom surface of the display apparatus. Using that edge as a reference line for purposes of comparing the blank of the present invention, with respect to conventional rectilinear cartons, it can be seen that the fold lines 130–134 form a generally concave excursion away from the reference line designated by the numeral 170 in FIG. 8.

It can be seen from the above that display apparatus according to principles of the present invention can be quickly and easily erected using a minimum of skill and investment of time. Further, the manipulations performed on the folded apparatus are intuitive and readily understood by store personnel unfamiliar with carton construction practices.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A display apparatus which may be hung or held upright on a planar surface and being formed from a one-piece blank, the display apparatus comprising a front wall, side walls, a rear wall, an upright support for supporting the display apparatus, the upright support extending from the rear wall, a clip mounted on the back wall of the apparatus and hidden from view from a front view of the display apparatus, the clip including means for mounting the clip in a C-channel, and a means for hanging the apparatus from a fastener, the hanging means associated with the back wall of the apparatus, the walls forming a receptacle extending from the back wall, the upright support including an easel support comprising a first flap hingedly connected to said rear wall along a first hinge line for pivoting movement between extended and retracted positions, said first flap having a bottom surface for supporting said display apparatus in an upright position;

a lock tap comprising a second flap at least partly struck out from the first flap so as to form an outer edge of the second flap and a recess in said first flap, the recess concavely curved with respect to said second flap, the second flap hingedly connected to said rear wall along a second hinge line for pivoting movement within the recess of said first flap, between extended and retracted positions;

said first flap having an outwardly directed notch in the recess edge portion; and said second flap movable within the recess of said first flap so as to engage said notch to lock said first and second flaps in their respective extended positions.

2. The display apparatus of claim 1 wherein the outer edge of the second flap defines a V-shape cut for engaging the notch of the first flap, and for passing along the concave recess edge portion of first flap, the means for hanging the apparatus comprising a hole in the clip, the clip being notably mounted on the back of the apparatus, the side walls being inclined from a reference true vertical line and the bottom wall being about parallel to a true horizontal line to position the bottom wall substantially flat on a horizontal support surface.

3. The display apparatus of claim 1 wherein the notch of the first flap is aligned along the second hinge line.

4. The display apparatus of claim 1 wherein the rear wall has multiple plies, with the upright support being formed from one of the multiple plies.

* * * * *